US006280025B1

(12) United States Patent
Beckstrom et al.

(10) Patent No.: US 6,280,025 B1
(45) **Date of Patent: *Aug. 28, 2001**

(54) INK CARTRIDGE RECEIVING POCKET ASSEMBLY

(75) Inventors: David W. Beckstrom, Fairfield, CT (US); Akehiro Ono, Nagoya (JP)

(73) Assignee: Pitney Bowes Inc., Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,655

(22) Filed: Jun. 8, 1999

(51) Int. Cl.[7] ..... B41J 2/175; B41J 29/13

(52) U.S. Cl. ..... 347/86; 347/108; 222/88; 222/325

(58) Field of Search ..... 347/86, 108; 220/823, 220/827, 828, 829, 830, 676; 222/325, 81, 82, 83.5, 88; 399/110, 111

(56) References Cited

U.S. PATENT DOCUMENTS 4,227,388 * 10/1980 Nigrelli et al. ..... 70/427
4,454,599 * 6/1984 Tsuchiya ..... 369/77.2
4,551,734 * 11/1985 Causley et al. ..... 347/86
5,331,373 * 7/1994 Nomura et al. ..... 399/111
5,541,631 * 7/1996 Hashimoto ..... 347/86
5,825,388 * 10/1998 Sasaki ..... 347/86
5,940,103 8/1999 Hetzer et al. ..... 347/86

FOREIGN PATENT DOCUMENTS 1-141750 * 6/1989 (JP) ..... B41J/3/04
3-189162-A * 8/1991 (JP) ..... B41J/2/175
5-162335 * 6/1993 (JP) ..... B41J/2/175

* cited by examiner

*Primary Examiner*—David F. Yockey
(74) *Attorney, Agent, or Firm*—Angelo N. Chaclas; Michael E. Melton

(57) ABSTRACT

A pocket assembly for use in an ink jet printer included in a mailing machine. The pocket assembly is adapted to receive an ink cartridge and includes: a housing defining a pocket for receiving the ink cartridge, a needle, a door and a door mechanism. The housing has an open end and a closed end and includes a recess extending away from the pocket. The needle is mounted to the housing closed end and protrudes into the pocket. The door is movably mounted to the housing and is located within the pocket. The door mechanism is operatively coupled with door for repositioning the door between a closed position blocking access to the needle and an open position allowing access to the needle. The door is seated in the recess when in the closed position so that the door is less likely to be manually repositioned to the open position.

10 Claims, 7 Drawing Sheets

INK CARTRIDGE RECEIVING POCKET ASSEMBLY

CROSS REFERENCE TO RELATED APPLICATIONS

This application is related to the following concurrently filed copending U.S. patent application Ser. No. 09/327,654, entitled DISPOSABLE INK CARTRIDGE (E-875), the disclosure of which is specifically incorporated herein by reference.

FIELD OF THE INVENTION

This invention relates to mailing machines including an ink jet printing system. More particularly, this invention is directed to a mailing machine including a pocket assembly for receiving a disposable ink cartridge.

BACKGROUND OF THE INVENTION

Ink jet printers are well known and have been adapted to a variety of applications, such as: general office printers, point of sale terminals, scientific recording devices and postage metering systems. Generally, ink jet printers include a print head and a supply of ink. In order to print, a series of ink drops are ejected from the print head onto paper until a desired image is achieved. To keep the print head supplied with ink, a variety of ink delivery systems have been developed. In applications where the print head has a long life and the printer exhibits high volume usage, it is desirable to provide a disposable ink cartridge for supplying ink. In this manner, when the ink has been exhausted, a new ink cartridge may be conveniently installed.

There are several important considerations for ink jet printers employing disposable ink cartridges. A few of the considerations are described generally below in no particular order of importance. One consideration is ease of use. The ink cartridge must be easily inserted into and removed from the ink jet printer. That is, even an inexperienced operator must find this process intuitive and quick so that time is not wasted. Another consideration is assurance of a proper mating relationship between the ink cartridge and the ink jet printer. In this manner, ink may be properly delivered from the ink cartridge to the print head. Otherwise, poor quality printing may result. Yet another consideration is operator safety. Replacing ink cartridges must not put the operator at risk of injury due to exposure to sharp objects or moving parts.

Typically, a mailing machine includes a postage metering system. Because postage metering systems store and dispense postage, print quality takes on an even greater significance. The ink jet printer must operate reliably so that the operator does not experience a loss of postal funds (money). Therefore, proper delivery of ink from the ink cartridge to the print head is critical.

Therefore, there is a need for a cost effective mailing machine including an ink jet printer having a pocket assembly for receiving a disposable ink cartridge that is both easy and safe to install/remove and is designed to provide a proper mating relationship between the ink cartridge and the pocket assembly.

SUMMARY OF THE INVENTION

Accordingly, it is an object of the present invention to provide a mailing machine that addresses those issues described above.

In accomplishing these and other objects there is provided a pocket assembly for use in a mailing machine. The pocket assembly is adapted to receive an ink cartridge and includes: a housing defining a pocket for receiving the ink cartridge, a needle, a door and a door mechanism. The housing has an open end and a closed end and includes a recess extending away from the pocket. The needle is mounted to the housing closed end and protrudes into the pocket. The door is movably mounted to the housing and is located within the pocket. The door mechanism is operatively coupled with door for repositioning the door between a closed position blocking access to the needle and an open position allowing access to the needle. The door is seated in the recess when in the closed position so that the door is less likely to be manually repositioned to the open position.

Therefore, it should now be apparent that the invention substantially achieves the objects and advantages discussed above. Additional objects and advantages of the invention will be set forth in the description that follows, and in part will be obvious from the description, or may be learned by practice of the invention. Moreover, the objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown through out the drawings, like reference numerals designate like or corresponding parts.

DETAILED DESCRIPTION OF THE PREFERRED EMBODIMENTS

Figure 1:
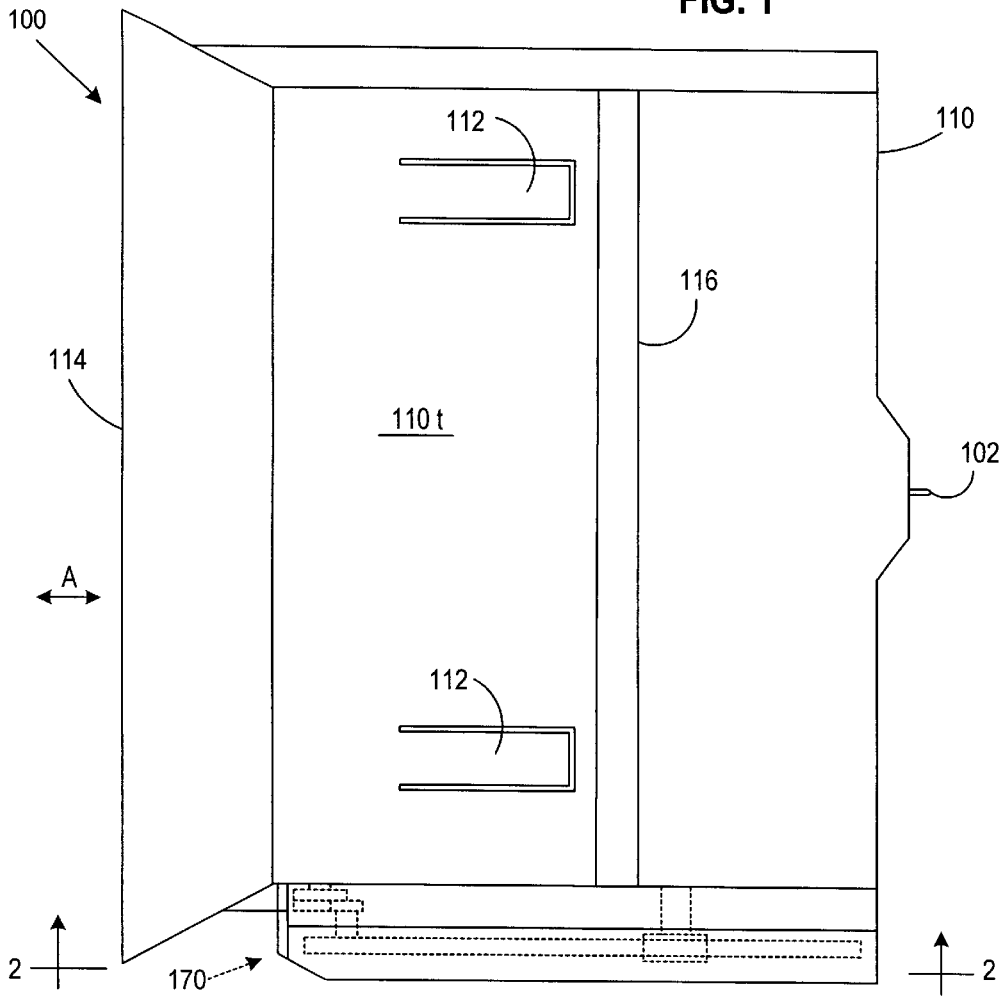
FIG. 1 is a top view of a pocket assembly into which an ink cartridge (not shown) may be installed in accordance with the present invention.
Figure 2:
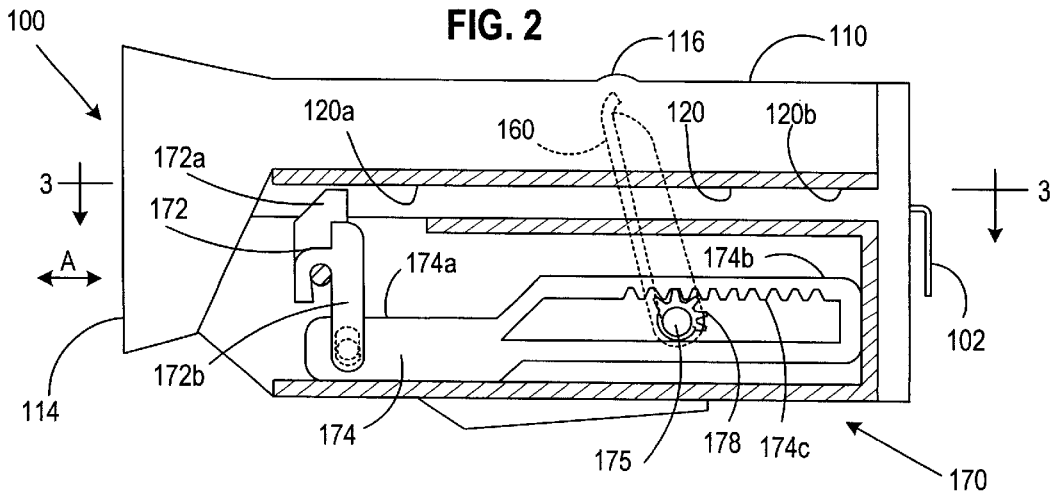
FIG. 2 is a side sectional view, as defined by line 2—2 as shown in FIG. 1, of the pocket assembly without the ink cartridge in accordance with the present invention.
Figure 7:
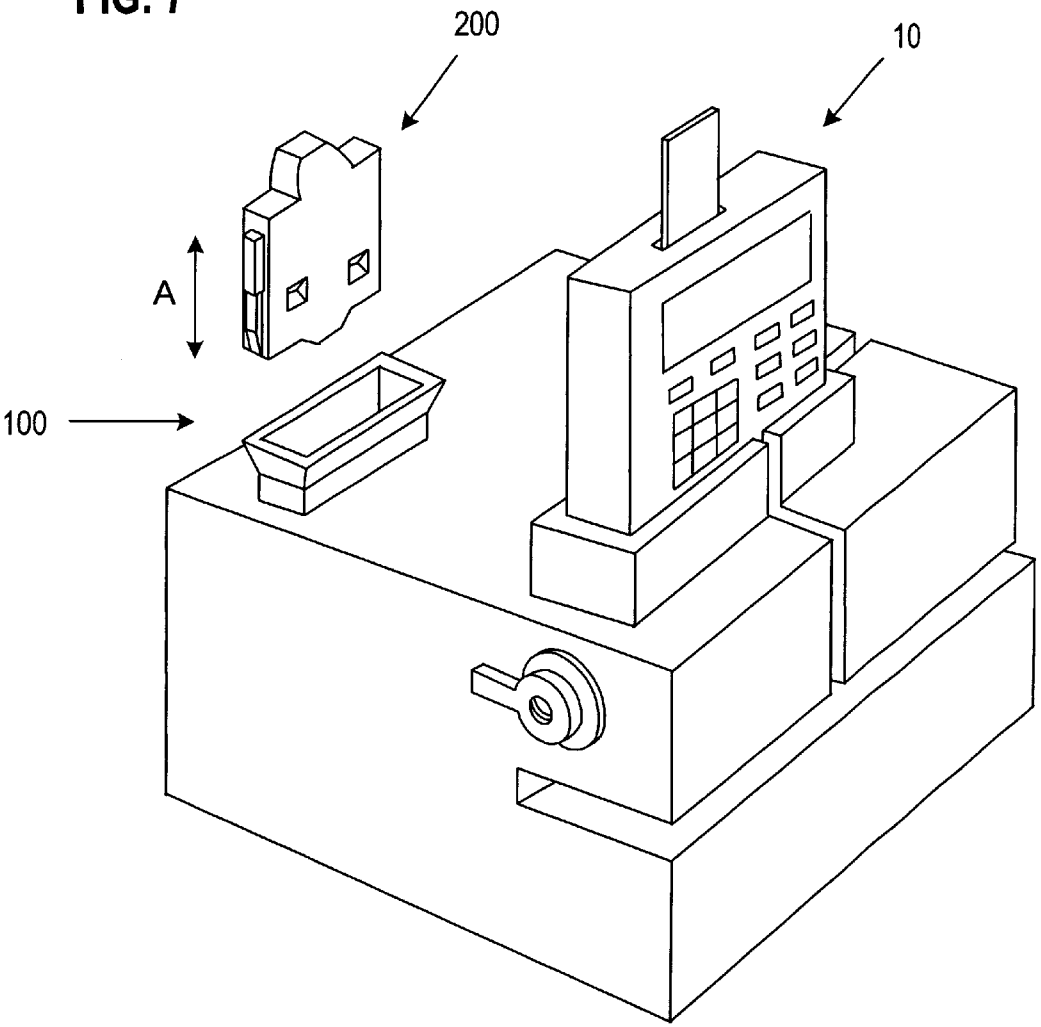
FIG. 7 is a partially exploded perspective view of a mailing machine including the pocket assembly fixably mounted therein in a vertical orientation and the ink cartridge in accordance with the present invention.

Referring to FIG. 1, a top view of a pocket assembly 100 into which an ink cartridge (not shown) may be installed in accordance with the present invention is shown. The pocket assembly 100 may be incorporated into a mailing machine 10 such as the one shown in FIG. 7 in any conventional manner. A more detailed description of the mailing machine 10 is provided in U.S. patent application Ser. No. 09/294,606, entitled POSTAGE METERING SYSTEM HAVING MULTIPLE POSTAGE METER CONFIGURATION CAPABILITY (E-863), filed on Apr. 19, 1999, the disclosure of which is specifically incorporated herein by reference. The pocket assembly 100 is fixably mounted to the mailing machine 10 in a vertical orientation and accepts an ink cartridge 200 in a direction indicated by a double sided arrow A in accordance with the present invention.

Referring to FIGS. 1, 2, 3, 4 and 5, the pocket assembly 100 includes a needle 102, a housing 110, a door 160, a door mechanism 170. The needle 102 is mounted to the housing 110 so as to protrude into the interior of the housing 110 and serves as a hollow tube for supplying a passage for the ink (not shown) within the ink cartridge (not shown) to flow out of the ink cartridge and into the ink jet printer (not shown).

The housing 110 is generally a thin walled box type structure that encloses a volume of space, more commonly referred to as a pocket 111. The housing 110 includes a pair of snaps 112 located on a top side 110t of the housing 110 and protruding into the pocket 111, an opening 114 at one end for receiving the ink cartridge (not shown) as indicated by the doubled sided arrow A, a recess 116, a pair of bosses 118 and a pair of grooves 120. The needle 102 is mounted at the other end of the housing 110 opposite to the opening 114.

The door 160 and the door mechanism 170 operate to protect an operator (not shown) from inadvertently touching the needle 102 when the ink cartridge (not shown) is not installed. The door 160 is pivotably mounted to the housing 110 within the pocket 111. The door 160 is designed to substantially close off a portion of the pocket 111 proximate to the needle 102. When the ink cartridge (not shown) is not installed, the door 160 is in a closed position (FIG. 4) blocking access to the needle 102 from the opening 114. In contrast, when the ink cartridge (not shown) is installed, the door 160 is in an open position (FIG. 4A) allowing access to the needle 102. The door mechanism 170 actuates the door 160 between the closed and open position and includes a pivot finger 172 having a first end 172*a* and a second end 172*b*, a push arm 174 having a first end 174*a* and a second end 174*b*, a spring 176 and a spur gear 178. The pivot finger 172 is rotatively mounted along its length to the housing 110 in any conventional manner, such as by snapping it onto a boss extending from the housing 110. The first pivot finger end 172*a* extends into one of the pair of grooves 120 while the second pivot finger end 172*b* is pivotably mounted in any conventional manner to the first push arm end 174*a*. The second push arm end 174*b* includes a rack gear 174*c* that is in operative engagement with the spur gear 178. The spur gear 178 and the door 160 are fixably mounted together, such as by fixably mounting on a common shaft 175, so that as the spur gear 178 rotates, the door 160 rotates in kind. The spring 176 extends between the door 160 and the housing 110 so that the door 160 is biased toward the closed position.

Figure 3:
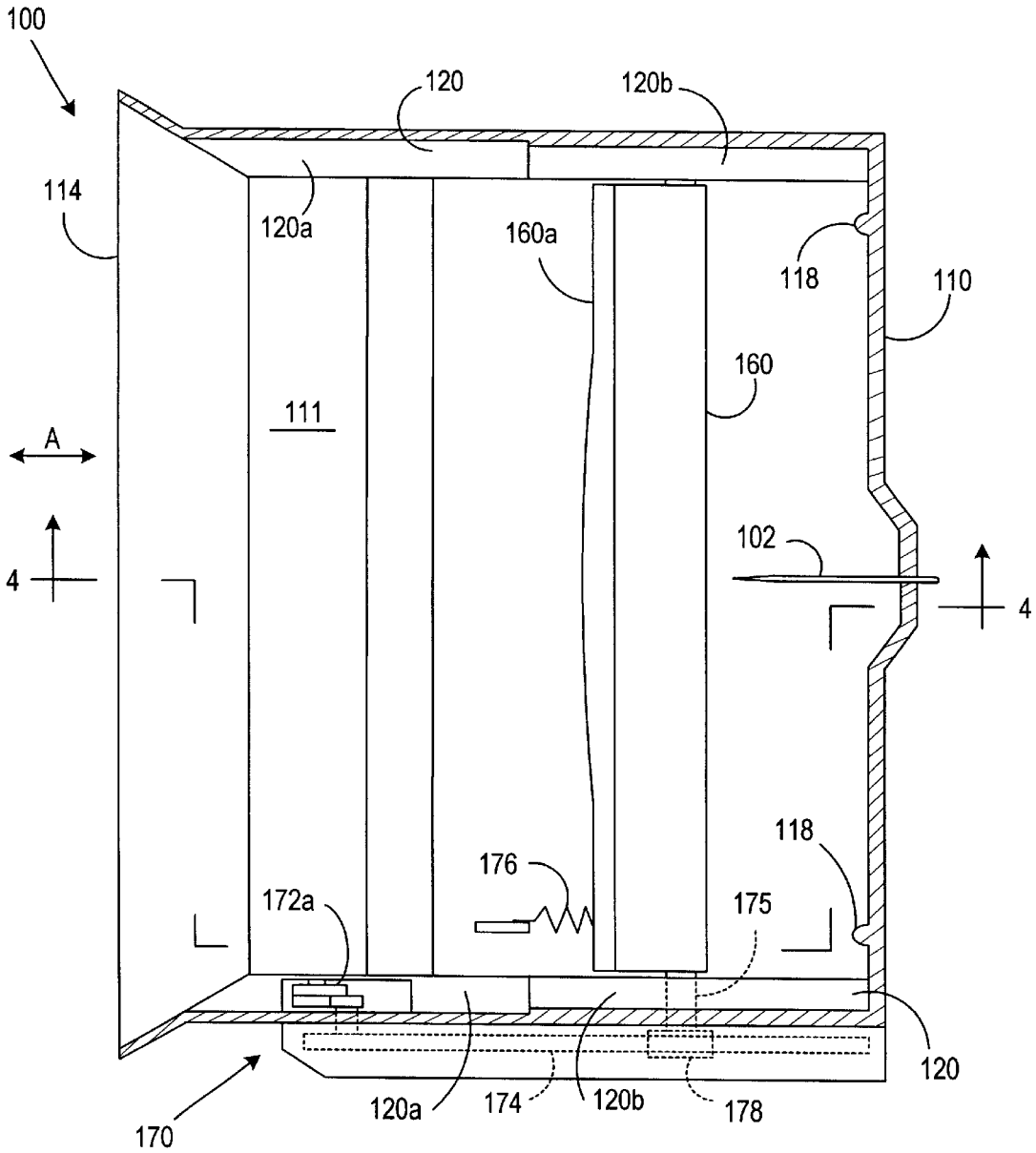
FIG. 3 is a top sectional view, as defined by the line 3—3 as shown in FIG. 2, of the pocket assembly without the ink cartridge in accordance with the present invention.
Figure 3A:
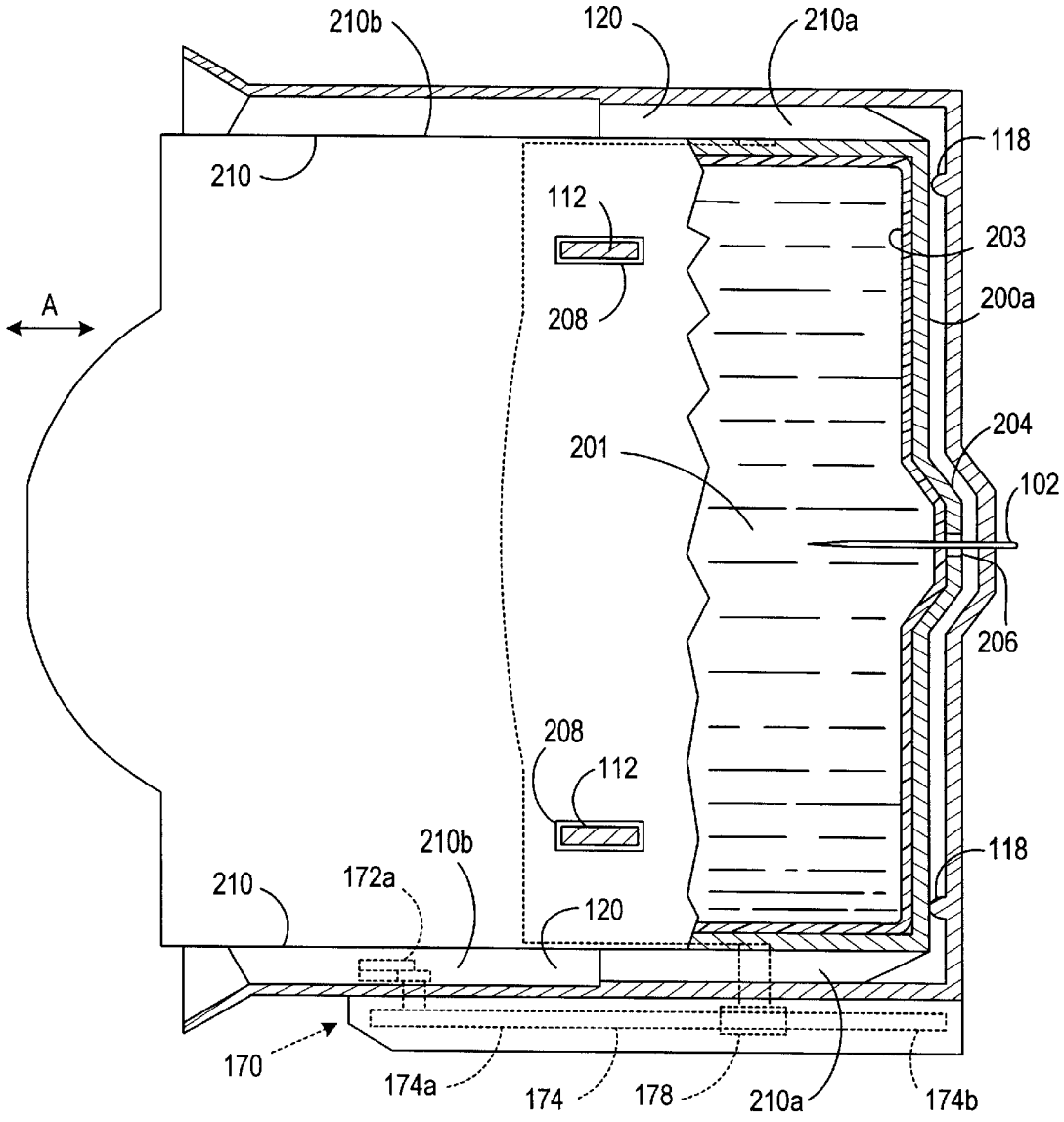
FIG. 3A is a top sectional view, as defined by the line 3—3 as shown in FIG. 2, of the pocket assembly having the ink cartridge installed therein in accordance with the present invention.
Figure 6:
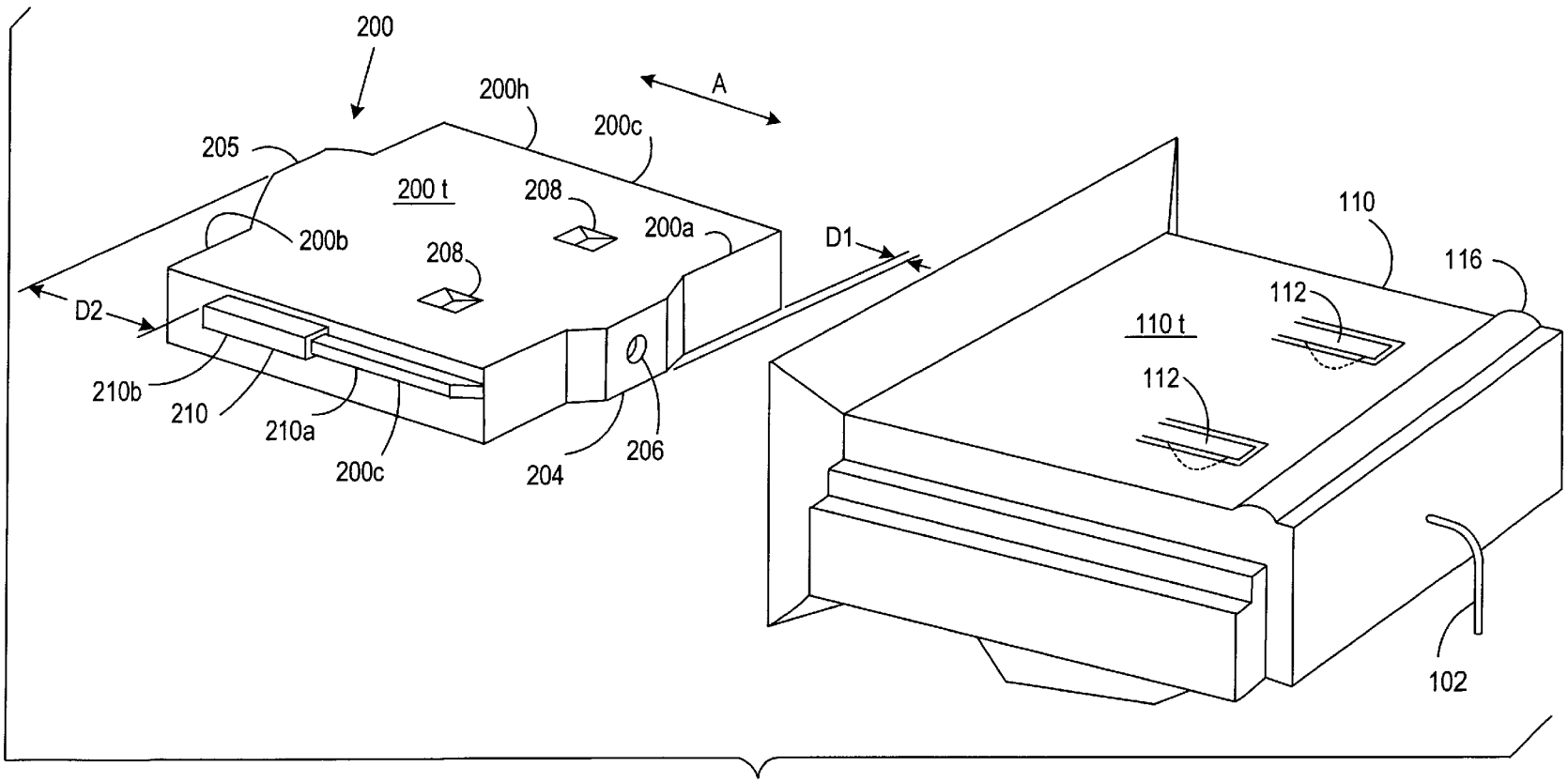
FIG. 6 is an exploded perspective view of the ink cartridge and the pocket assembly in accordance with the present invention.

Referring to FIGS. 6 and 3A, an exploded perspective view of the ink cartridge 200 and the pocket assembly 100 in accordance with the present invention is shown. The ink cartridge 200 includes a main body or housing 200*h*, a supply of ink 201 contained within an ink bag 203 in turn located within the housing 200*h*, an extended region 204 on a first end 200*a* of the main body 200*h*, an extended region 205 on a second end 200*b* of the main body 200*h*, a rubber septum 206 located within the extended region 204, a pair of recesses 208 located on a top side 200*t* of the main body 200*h* and a pair of tabs 210 (only one visible) located on lateral sides 200*c* of the main body 200*h*. The tabs 210 includes a first portion 210*a* and a second portion 210*b* larger than the first tab portion 210*a*. The pair of recesses 208 are adapted to receive the pair of snaps 112, respectively while the pair of tabs 210 are adapted to travel within the pair of grooves 120 (not shown), respectively.

Figure 4:
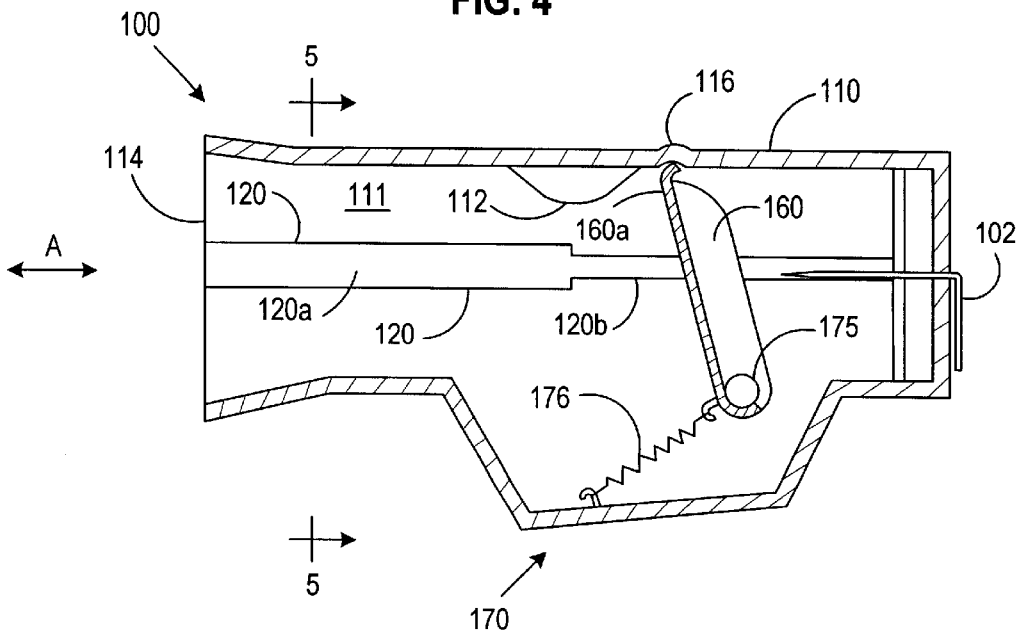
FIG. 4 is a side sectional view, as defined by the line 4—4 as shown in FIG. 3, of the pocket assembly without the ink cartridge in accordance with the present invention.

With the structural aspects of the present invention described as above, various preinstallation operational aspects will now be described. Referring primarily to FIG. 4 in view of the structure of FIGS. 1, 2, 3, 5, and 6, in the absence of the ink cartridge 200, the spring 176 maintains the door 160 in the closed position. In the closed position, the door 160 blocks access to the needle 102. Thus, if the operator were to reach inside the pocket 111, then the door 160 prevents inadvertent injury due to touching the needle 102. As an additional safety measure, a top edge 160*a* of the door 160 is seated in the recess 116. The top edge 160*a* and the recess 116 are designed to have conforming shapes (both rounded as shown) so that the operator cannot get a grip on the door top edge 160*a* and pull the door 160 toward the open position. As still another safety measure, the door top edge 160*a* is seated in the recess 116 so that the door 160 assumes a reclined angle (toward the opening 114). Thus, provided that the door 160 is sufficiently rigid (a pattern of strengthening ribs may be employed), the operator cannot push the door 160 open due to the positive interference between the door 160 and the housing 110.

With the pre-installation operational aspects of the present invention described as above, various operational aspects concerning installation of the ink cartridge 200 will now be described. Referring primarily to FIGS. 5, 5A and 6 in view of FIGS. 1, 2, 3, 3A, 4 and 4A, the cartridge 200 and the pocket assembly 100 are adapted so that the cartridge 200 can only be assembled in one particular orientation. Generally, the tabs 210 are offset from the center of the lateral sides 200*c* while the grooves 120 are correspondingly offset from the center of the pocket 111. In this way, the cartridge 200 may only be inserted so that the cartridge top side 200*t* is aligned substantially parallel with and directly opposite to the housing top side 110*t*.

Figure 4A:
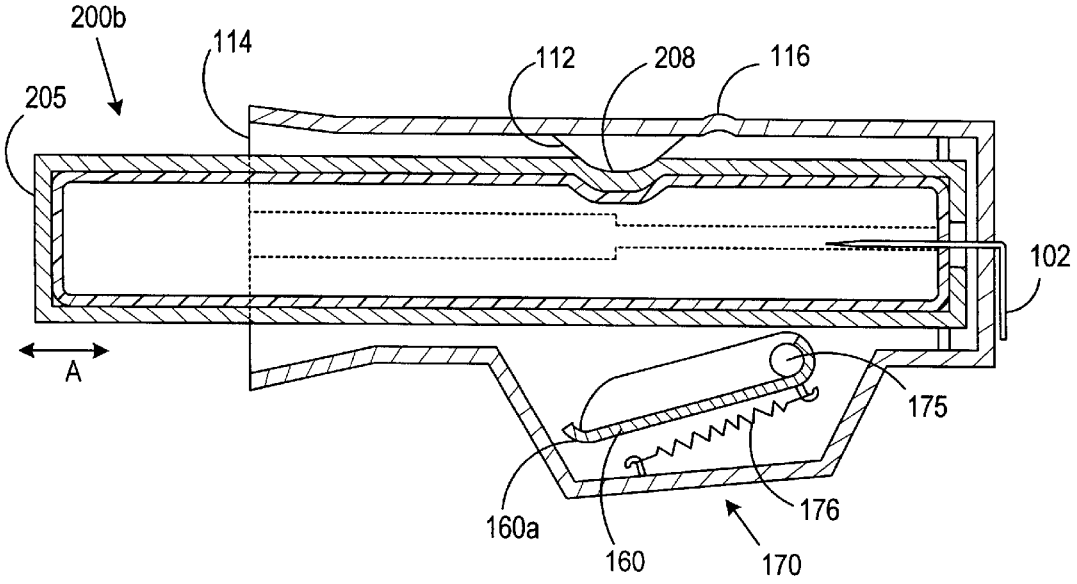
FIG. 4A is a side sectional view, as defined by the line 4—4 as shown in FIG. 3, of the pocket assembly having the ink cartridge installed therein in accordance with the present invention.
Figure 5:
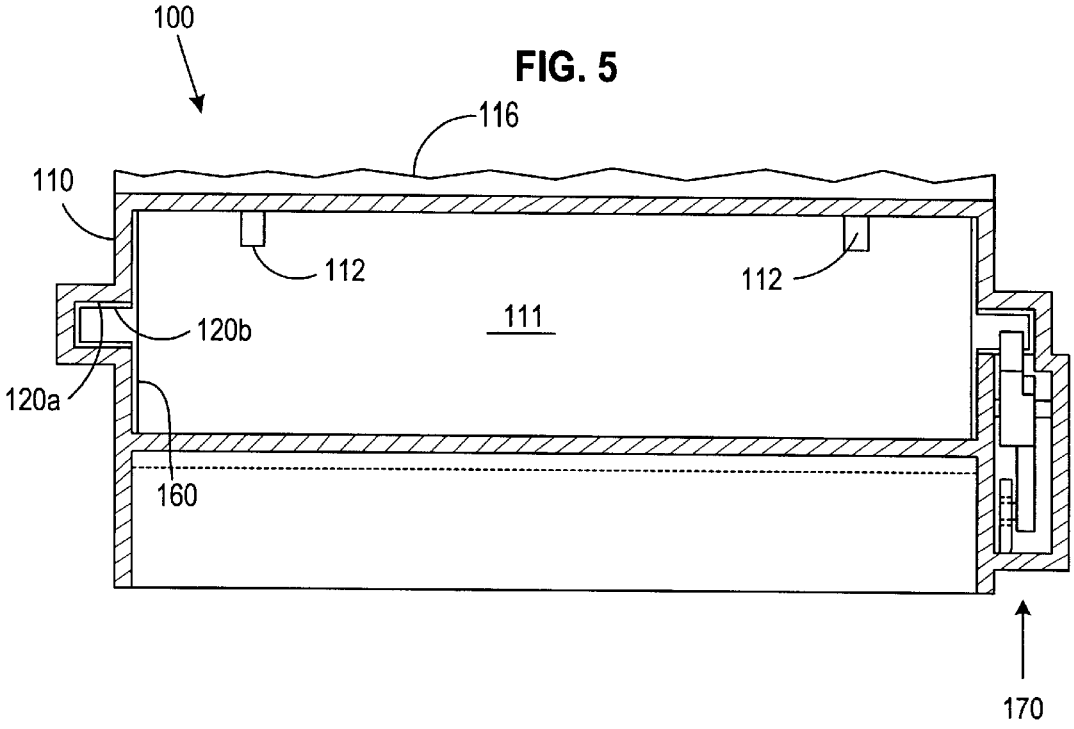
FIG. 5 is an end sectional view, as defined by the line 5—5 as shown in FIG. 4, of the pocket assembly without the ink cartridge in accordance with the present invention.
Figure 5A:
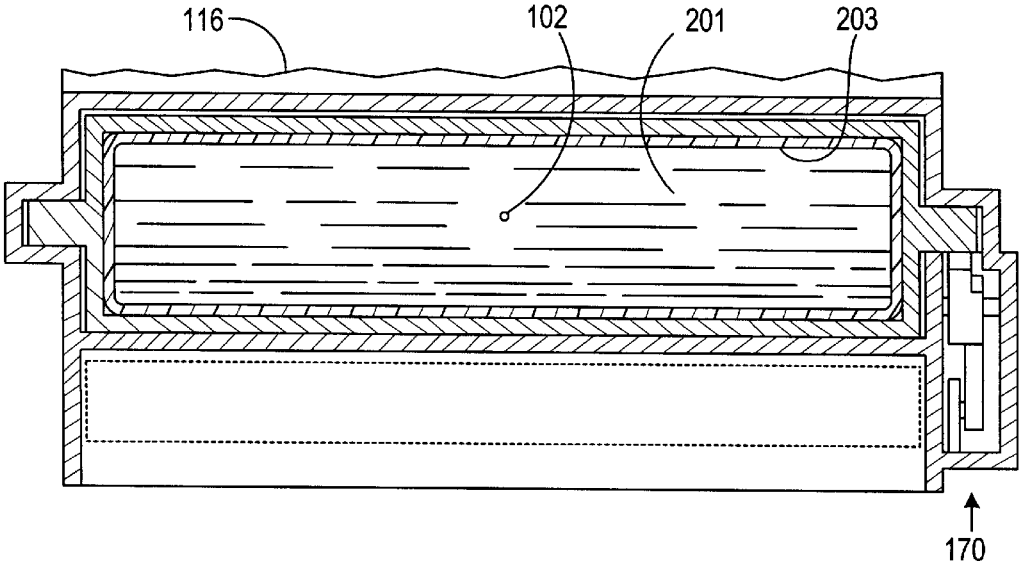
FIG. 5A is an end sectional view, as defined by the line 5—5 as shown in FIG. 4, of the pocket assembly having the ink cartridge installed therein in accordance with the present invention.

Referring primarily to FIGS. 2, 4, 4A, 5 and 5A in view of FIGS. 1, 3, 3A, and 6, the cartridge 200 is installed in the pocket assembly 100 by inserting the cartridge first end 200*a* containing the rubber septum 206 into the pocket 111. The tabs 210 fit within and slide along the grooves 120, respectively, as the cartridge 200 is inserted. During insertion, one of the tabs 210 engages the pivot finger first end 172*a* that protrudes into the groove 120. As the cartridge 200 continues toward the needle 102, the pivot finger 172 rotates causing the push arm 174 to translate so that the spur gear 178 rotates counter-clockwise (as view in FIG. 2) which in turn causes the door 160 to rotate from the closed position to the open position. It should be noted that the door 160 should reach the open position prior to the arrival of the cartridge first end 200*a* so that an interference does not occur. Referring to FIGS. 3A and 4A, the cartridge 200 is shown fully installed within the pocket assembly 100. In this position, the needle 102 has pierced the septum 206 and entered the ink bag 203 so that the needle 102 is in contact with the ink 201. Also, the snaps 112 have seated themselves in the recesses 208. This serves as an additional measure to keep the cartridge 200 from inadvertently dislodging from the final installation position due to vibration or other reasons.

To prevent the needle 102 from becoming damaged, the cartridge 200 is not allowed to "bottom outs" in the pocket 111. Instead, the cartridge 200 comes into contact with the bosses 118 to define a final or forward most insertion position for the cartridge 200. In this forward most insertion position, the cartridge first end 200*a* does not contact the housing 110. As a result, the shear forces on the needle 102 are reduced. To provide further positive tactile feedback to the operator, the recesses 208 and corresponding snaps 210 are located on their respective parts to be in proper mating relationship in the final insertion position.

To further prevent the needle 102 from becoming damaged, the cartridge 200 will only cause the door 160 to rotate to the open position when the cartridge end 200*a* is inserted. If the cartridge second end 200*b* is inserted, then the door 160 will not rotate to the open position. Since the extended region 205 of the cartridge second end 200*b* contacts the door 160 before the tab 210 sufficiently engages the pivot finger 172 to rotate the door 160 to the open position, the cartridge 200 cannot reach the needle 102 when inserted in this manner. Here, the important consideration is that a first distance D1 (measured along the insertion direction) between a forward most point of the cartridge first end 200*a* and the tab first portion 210*a* allows the pivot finger 172 to be engaged without obstructing the movement of the door 160 while the a second distance D2 (measured along the insertion direction) between a rearward most point of the cartridge second end 200*b* and the tab second portion 210*b* does not allow engagement of the pivot finger 172 sufficient to rotate the door 160 to the open position before the rearward most point contacts the door 160. Thus, the first distance D1 is less than the second distance D2. Preferably, the rearward most point contacts the door 160 before the tab second portion 210 reaches the pivot finger 172. Accordingly, those skilled in the art will recognize that there is only one orientation for which the cartridge 200 will reach the needle 102 so that the operator cannot improperly install the cartridge 200.

With the structural and operational aspects of the present invention described as above, various dimensional aspects will now be described. Referring to FIGS. 3, 4 and 5, the grooves 120 are dimensioned (less than approximately 0.250 inches wide, preferably about 0.200 inches) to be smaller than an adult's finger so that the pivot finger 172 cannot be articulated manually. The depth of the grooves 120 must be sufficient to accommodate the pivot finger 172. Preferably, the pivot finger 172 is more than about 0.200 inches deep into the groove 120. This provides an added measure of safety for operators that may insert their hand into the pocket 111.

Referring to FIGS. 3, 3A, 4, 4A, 5, 5A and 6, the tabs 210 perform dual functions. First, the tabs 210 and the grooves 120 are dimensioned to facilitate insertion of the cartridge 200 and proper alignment of the septum 206 with the needle 102. Second, as described above, the tabs 210 engage the door mechanism 170. The tab first portion 210*a* is smaller than the tab second portion 210*b*, preferably on all three sides of the tab 210 by about 0.030 inches per side. Similarly, the grooves 120 includes a first portion 120*a* and a second portion 120*b* where the groove second portion 120*b* is smaller than the groove first portion 120*a*, preferably on all three sides of the groove 120 by about 0.030 inches per side. Thus, when the cartridge first end 200*a* is initially inserted into the pocket 111, sufficient clearance (about 0.080 inches per side) exists between the tab first portion 210*a* and the groove first portion 120*a* to facilitate easy installation by the operator. However, in the final insertion position, the tab first portion 210*a* is in mating relationship with the groove second portion 120*b* while the tab second portion 210*b* is in mating relationship with the groove first portion 120*a*. In this position, the clearance (about 0.020 inches per side) has been reduced to that which is necessary to allow the cartridge 200 to be installed without binding and provide for proper alignment of the septum 206 with the needle 102 to avoid damage to the needle 102 during installation.

Many features of the preferred embodiment represent design choices selected to best exploit the inventive concepts of the present invention. However, those skilled in the art will recognize that modifications to the preferred embodiment may be made with departing from the spirit of the present invention. For example, the tabs and grooves may be tapered instead of stepped to produce the same desired effects as described above. As another example, only one tab and one groove may be employed. As yet another example, only one snap and one recess may be employed. As yet still another example, only the snap(s), the recess(es) and the tab(s) may all be located on the same surface of the housing. Still further, those skilled in the art will recognize that the features described above are largely independent and may be employed in a variety of combinations depending upon the needs of the particular application for the disposable ink cartridge.

Therefore, the inventive concepts in their broader aspects are not limited to the specific details of the preferred embodiment but are defined by the appended claims and their equivalents.

What is claimed is:

1. A pocket assembly for use in an ink jet printer, the pocket assembly adapted to receive an ink cartridge, the pocket assembly comprising:

a housing defining a pocket for receiving the ink cartridge, the housing having an open end and a closed end, the housing including a recess extending away from the pocket;

a needle mounted to the housing closed end and protruding into the pocket;

a door pivotally mounted to the housing and located within the pocket, the door including a top edge; and a door mechanism operatively coupled with the door for repositioning the door between a closed position blocking access to the needle and an open position allowing access to the needle where the door pivots toward the open end when repositioning between the closed position and the open position, the door top edge being seated in the recess when the door is in the closed position so that the door top edge is not manually accessible from the open end.

2. The pocket assembly of claim 1, wherein:

the housing further includes a groove extending away from the pocket, the groove including a first portion proximate to the needle and a second portion proximate to the housing open end, the second portion being larger than the first portion; and the groove is adapted to receive a tab located on the ink cartridge so that as the ink cartridge is installed in the pocket, the ink cartridge is properly aligned with the needle.

3. The pocket assembly of claim 2, wherein:

the housing further includes a boss located on the housing closed end and protruding into the pocket; and when installed, the ink cartridge contacts the boss so as to establish a final installation position.

4. The pocket assembly of claim 3, wherein:

the door mechanism protrudes into the groove; and during installation of the ink cartridge, the tab activates the door mechanism to reposition the door from the closed position to the open position.

5. The pocket assembly of claim 4, wherein:

the groove is less than 0.250 inches wide; and the door mechanism is more than 0.200 inches deep within the groove.

6. The pocket assembly of claim 5, wherein:

the housing further includes a snap protruding into the pocket, the snap being adapted to seat within a recess located on the ink cartridge so that the ink cartridge is secured in the final installation position.

7. The pocket assembly of claim 1, wherein:

the housing further includes a groove extending away from the pocket; and the groove is adapted to receive a tab located on the ink cartridge so that as the ink cartridge is installed in the pocket, the ink cartridge is properly aligned with the needle.

8. The pocket assembly of claim 7, wherein:

the door mechanism protrudes into the groove; and during installation of the ink cartridge, the tab activates the door mechanism to reposition the door from the closed position to the open position.

9. The pocket assembly of claim 8, wherein:

the groove is less than 0.250 inches wide; and door mechanism is more than 0.200 inches deep within the groove.

10. The pocket assembly of claim 9, wherein:

the housing further includes a snap protruding into the pocket, the snap being adapted to seat within a recess located on the ink cartridge so that the ink cartridge is secured in a final installation position.

* * * * *